US005082316A

United States Patent [19]

Wardlaw

[11] Patent Number: 5,082,316

[45] Date of Patent: * Jan. 21, 1992

[54] RELEASE MECHANISM AND METHOD WITH ALARM CIRCUIT

[75] Inventor: Russell Wardlaw, San Rafael, Calif.

[73] Assignee: The Cookson Company, Phoenix, Ariz.

[ * ] Notice: The portion of the term of this patent subsequent to Feb. 26, 2008 has been disclaimed.

[21] Appl. No.: 628,615

[22] Filed: Dec. 14, 1990

Related U.S. Application Data

[63] Continuation-in-part of Ser. No. 444,820, Dec. 1, 1989, Pat. No. 4,995,651.

[51] Int. Cl.[5] ..... E05C 3/12

[52] U.S. Cl. ..... 292/201; 160/209; 292/DIG. 36

[58] Field of Search ..... 292/92, 201, DIG. 36, 292/336.3, 144, 345; 160/209, 170, 133

[56] References Cited

U.S. PATENT DOCUMENTS

| | | | |
|---|---|---|---|
| 2,327,778 | 8/1943 | Ferris et al. | 292/DIG. 36 X |
| 2,607,586 | 8/1952 | Schlytern | 292/201 X |
| 3,309,664 | 3/1967 | Deutsch et al. | 292/144 X |
| 3,426,829 | 2/1969 | McDaniel et al. | 160/209 X |
| 3,576,119 | 4/1971 | Harris | 292/144 X |
| 3,955,840 | 5/1976 | Rawls et al. | 292/201 X |
| 4,328,985 | 5/1982 | Logan | 292/92 X |
| 4,470,625 | 9/1984 | Walsh et al. | 292/92 X |
| 4,995,651 | 2/1991 | Wardlaw | 292/DIG. 36 X |

*Primary Examiner*—Richard E. Moore
*Attorney, Agent, or Firm*—Flehr, Hohbach, Test, Albritton & Herbert

[57] ABSTRACT

Release mechanism and method for fire doors and the like. The door is normally held in an open position by an electrically energized actuator and is released for closing upon deenergization of the actuator. An eneergizing current is supplied to the actuator from a source to energize the actuator, and a limited amount of energy from the source is stored in an element such as a capacitor. Upon interruption of the current from the source to the actuator, the actuator is energized with the stored energy to prevent the door from closing for a limited period of time after the current is interrupted. An alarm circuit is included in some embodiments to porivde a warning when the current has been interrupted and the door is about to close.

19 Claims, 3 Drawing Sheets

RELEASE MECHANISM AND METHOD WITH ALARM CIRCUIT

This is a continuation-in-part of Ser. No. 07/444,820 filed Dec. 1, 1989, now U.S. Pat. No. 4,995,651, issued Feb. 26, 1991.

This invention pertains generally to release mechanisms for fire doors and the like and, more particularly, to a release mechanism and method in which the closing of a door is delayed for a preset period of time after the occurrence of the event which initiates the closing.

Fire doors and other closures are commonly provided with release mechanisms which hold the doors or closures in an open position and release them for movement to a closed position in response to an event such as the actuation of a fire alarm or a smoke detector. Such systems usually receive operating power from the electrical system of the building in which they are installed, and a loss of operating power can cause the mechanism to be released.

Fire alarms and smoke detectors are tested periodically to assure that they are in proper working order. In instances where power interruption is momentary, such as from a power surge when lightning strikes, in order to prevent all of the fire doors or other closures in a building from closing and having to be reset, some release mechanisms are designed to delay the closing of the doors or closures for a period of time sufficient to permit the power to be restored.

U.S. Pat. No. 4,130,156 discloses a release mechanism having a normally energized solenoid and a dashpot which controls the rate of movement of a portion of the mechanism to delay the release of the door following deenergization of the solenoid. The dashpot has an adjustable vent opening which can be set to provide the desired delay. This is a "fail-safe" system.

U.S. Pat. No. 3,955,840 discloses a release mechanism in which a time delay device is connected electrically in series with a normally deenergized solenoid coil to delay completion of the energizing circuit for the solenoid and thereby prevent undesirable actuation of the release mechanism should there be a false short-term application of power to the circuit which would otherwise energize the coil and actuate the mechanism. This is not a fail-safe system and would not meet the standards of the fire codes for use in public buildings such as hospitals and the like.

It is in general an object of the invention to provide a new and improved release mechanism and method for fire doors and the like.

Another object of the invention is to provide a release mechanism and method of the above character in which actuation is delayed to permit testing or restoration of operating power before a door controlled by the mechanism is released.

Another object of the invention is to provide a release mechanism and method of the above character in which an alarm is given in the event that operating power is interrupted.

These and other objects are achieved in accordance with the invention by holding a release member in a holding position with an electrically energized actuator, supplying an energizing current to the actuator from a source to energize the actuator, storing a limited amount of energy from the source in an element such as a capacitor, interrupting the delivery of current from the source to the actuator, and energizing the actuator with the stored energy to prevent release of the retaining member for a limited period of time after the current is interrupted. In some embodiments, an alarm circuit provides a warning when the current has been interrupted and the retaining member is about to be released.

Figure 1:
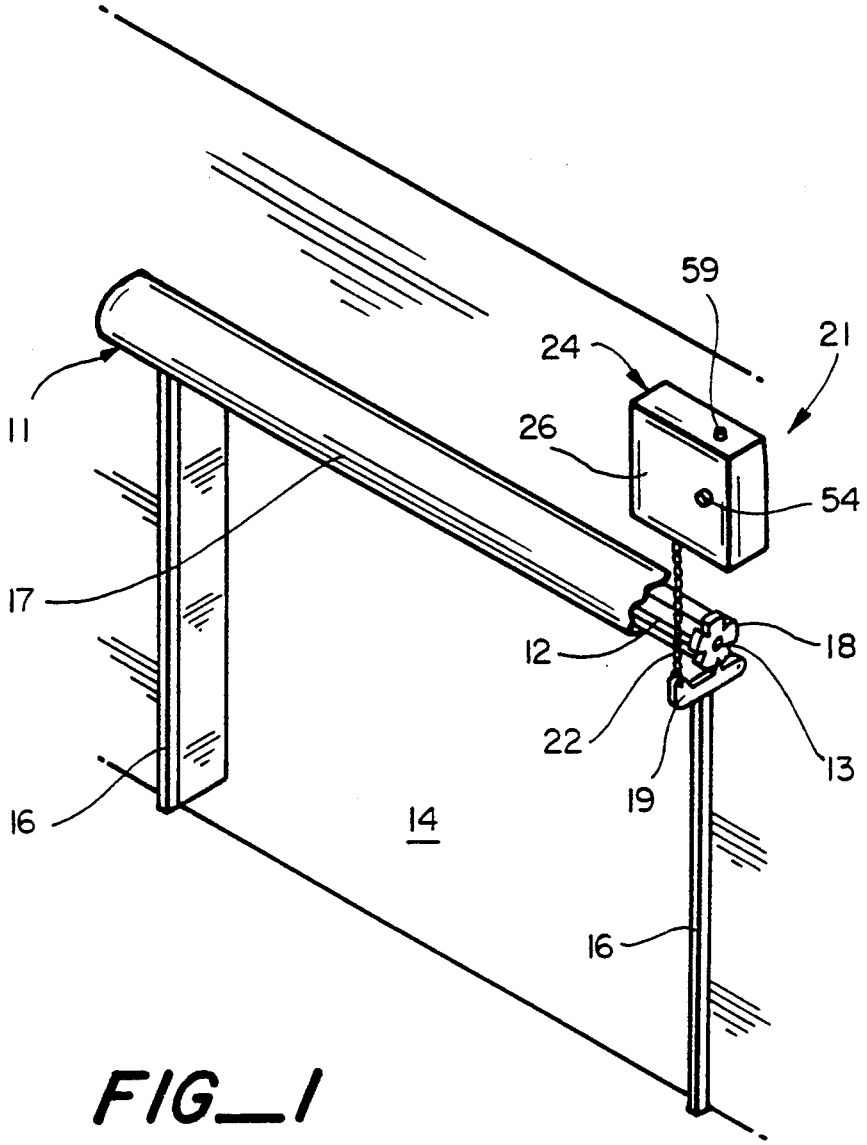
FIG. 1 is an isometric view, partly broken away and somewhat schematic, of one embodiment of a rolling fire door assembly with a release mechanism according to the invention.

In FIG. 1, the invention is illustrated in connection with a rolling fire door assembly 11. This assembly includes a door 12 which is mounted on a horizontally extending axle 13 above a door opening 14 for movement between raised (open) and lowered (closed) positions. Vertically extending guide rails 16 guide the edges of the door at the sides of the opening. The door is rolled about the axle and tends to unwind from the axle and drop to the closed position by its own weight. The axle is enclosed within a housing 17 which also covers the door when it is in its rolled up or raised position.

Movement of the door toward the closed position is counterbalanced by a coil torsion spring (not shown) mounted within the barrel upon which the rolling door wraps. For example, see U.S. Pat. No. 3,637,004 by the present inventor. A detent wheel 18 is affixed to the axle 13, and a release lever 19 is pivotally mounted for movement into and out of locking engagement with the wheel. Unless held in the locking position, the release lever tends to drop out of engagement with the wheel and permit the axle 13 to rotate, allowing the door 12 to move toward the closed position.

The door is held in the raised position by a release mechanism 21 which is mounted on the wall above the housing. The release mechanism is connected to release lever 19 by a chain or cable 22 in such manner that the release lever is held in locking engagement with detent wheel when the chain is in tension, i.e., when the upper end of the chain is held by the release mechanism. The chain includes a fusible link which is adapted to melt and thereby release the door in response to the heat produced by a fire.

The release mechanism is enclosed within a generally rectangular housing 24 having a front cover 26, a rear panel 27, a top panel 28, a bottom panel 29 and side panels 31, 32, with mounting lugs 33 affixed to the top and bottom panels.

Figure 2:
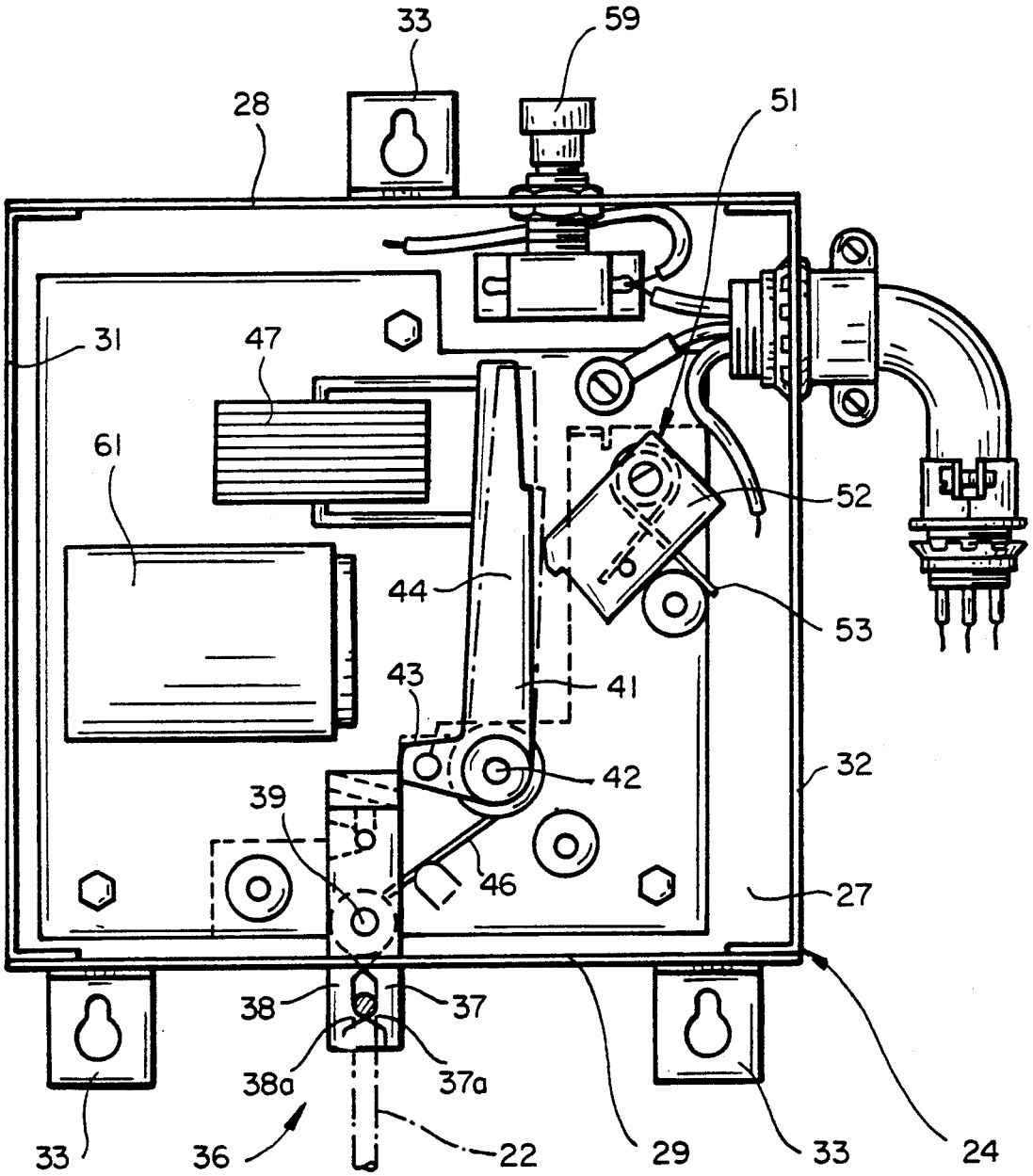
FIG. 2 is a plan view of the release mechanism in the embodiment of FIG. 1.

The release mechanism includes a hook assembly 36 which releasably engages the uppermost link of chain 22 to hold the door in the open position. This assembly comprises a pair of stationary parts 37 and a movable part 38 which extend through an opening in the bottom panel of housing 24. The two stationary parts are identical, and they are spaced apart and aligned in registration with each other. The movable part is positioned between the stationary parts and is mounted on a shaft 39 for pivotal movement between open and closed positions relative to the stationary parts. The hook parts have finger portions 37*a*, 38*a* which face each other and intermesh to capture the chain when the hook assembly is in a closed or holding position. This is the position in which the assembly is shown in FIG. 2. When the movable part pivots in a clockwise direction toward the open position, finger portion 38*a* moves away from finger portions 37*a*, and the chain is released.

The hook assembly is held in the closed position by an L-shaped release lever 41 which is pivotally mounted on a shaft 42 for movement into and out of engagement with the movable hook part 38. The lever has a relatively short lower arm 43 and a longer upper arm 44. In the holding position, the outer end of lower arm 43 abuts against the upper portion of hook part 38 and thus holds the hook assembly in its closed position. When lever 41 rotates in a clockwise direction, as viewed in FIG. 2, arm 43 moves clear of hook part 38, and the hook part is free to move to its open position. The lever is urged toward this tripped position by a spring 46.

Means is provided for retaining release lever 41 in its latched or holding position with arm 43 in engagement with hook part 38. This means includes an electrically energized holding coil 47 which draws the upper portion of lever arm 44 toward the left by magnetic attraction when energized. The lever is illustrated in full lines in its latched or holding position in FIG. 2. When the holding coil is deenergized, spring 46 rotates the lever in a clockwise direction to the tripped position which is shown in broken lines in FIG. 2.

In one presently preferred embodiment, the entire release lever 41 is fabricated of a magnetically conductive material. However, it is only necessary to have the magnetic material near the coil, and the lever can be constructed accordingly, e.g. by fabricating only the upper portion of arm 44 of magnetic material or by attaching a piece of magnetic material to the upper portion of the arm. Alternatively, the holding coil 47 can be in the form of a solenoid having its movable armature connected to the upper portion of the lever arm 44, in which case no magnetically conductive material is required in the lever arm.

A manually operated cam assembly 51 is provided for resetting lever 41 from the tripped position to the latched position. This assembly includes a pivotally mounted eccentric block 52 which is urged in a counterclockwise direction away from the upper arm 44 of the lever by a spring 53. A knob 54 connected to the cam block is positioned outside the front cover of enclosure 24 to provide means for manually rotating the block in the clockwise direction against the force of spring 53 to return the lever to the holding position.

Coil 47 is energized from the electrical service for the building in which the door is located through a power supply 56. This supply is illustrated in simplified form in FIG. 3 as having a transformer 57 connected to the a.c. supply lines and a rectifier bridge 58 connected to the secondary winding of the transformer. The output of the bridge is connected to coil 47, and a normally closed test switch 59 is connected in series with one of the supply lines to the transformer. This switch is mounted on the upper panel of housing 24 and has a manually operable pushbutton which is accessible outside the housing. In normal operation, the power supply is energized and coil 47 receives an energizing current from the supply. A suitable switching device (not shown) can be connected to the circuit to interrupt the current to the coil in response to a signal from a fire alarm, a smoke detector, or other signalling device.

Means is provided for delaying deenergization of the holding coil for a predetermined period of time following interruption of the energizing current from the power supply. This means includes a capacitor 61 which is connected electrically in parallel with the holding coil. During normal operation of the system, the capacitor is charged with energy from the power supply. Upon interruption of the power from the supply, the capacitor continues to supply operating current to the coil to keep the coil energized until the charge on the capacitor drops below the level required to hold the release lever against the force of spring 46. When the holding coil is a solenoid, the capacitor continues to supply operating current to the solenoid coil to keep the coil energized until the charge on the capacitor drops below the level required to hold the armature of the solenoid against the force of the spring 46.

An adjustable resistor 62 is connected in parallel with the capacitor to provide means for controlling the rate at which the capacitor is discharged and, thus, the length of the delay. In one presently preferred embodiment, the power supply provides an output voltage on the order of 24 volts, the capacitor has a capacitance on the order of 28,000 microfarads, the coil has a resistance on the order of 160 ohms, and the resistor has a maximum resistance on the order of 50 ohms. The resistor is typically set to provide a delay on the order of 5 to 20 seconds. If desired, a fixed resistor can be utilized to provide a given delay, or the resistor can be connected in parallel with the capacitor or in series with the coil.

Operation and use of the release mechanism, and therein the method of the invention, are as follows. It is assumed that the door is initially in its rolled up or open position and that hook assembly 36 is engaged with chain 22 to hold the door in this position. Energizing current is supplied to the holding coil by power supply 56, and capacitor 61 is maintained in a charged condition by current from the supply.

Upon the interruption of current from the power supply, e.g. by actuation of the test switch 59 or upon an interruption in the building power, the holding coil is maintained in its energized state for a limited period of time by the charge which has been stored in the capacitor. This period of time is selected in accordance with the requirements of the building in which the unit is installed. Within this period of time, the alarm system is tested or the sequence for bringing emergency power is initiated. If the alarm test event or power switching event is completed within the delay period, the unit will reset itself when power is again supplied to the line.

However, in the event of an earthquake, fire, or other event which causes the municipal power network which supplies the building to shut down for a time exceeding the period of time for restoration permitted by the system, the charge on the capacitor will be depleted. When this happens, the lever 44 is released, which permits the hook assembly 36 to open, thereby releasing chain 22 and permitting the door to drop to its closed position.

The system is reset by raising the door, engaging chain 22 with hook assembly 36, rotating cam assembly 51 to return lever 41 to its holding position, and reenergizing the holding coil.

Figure 3:
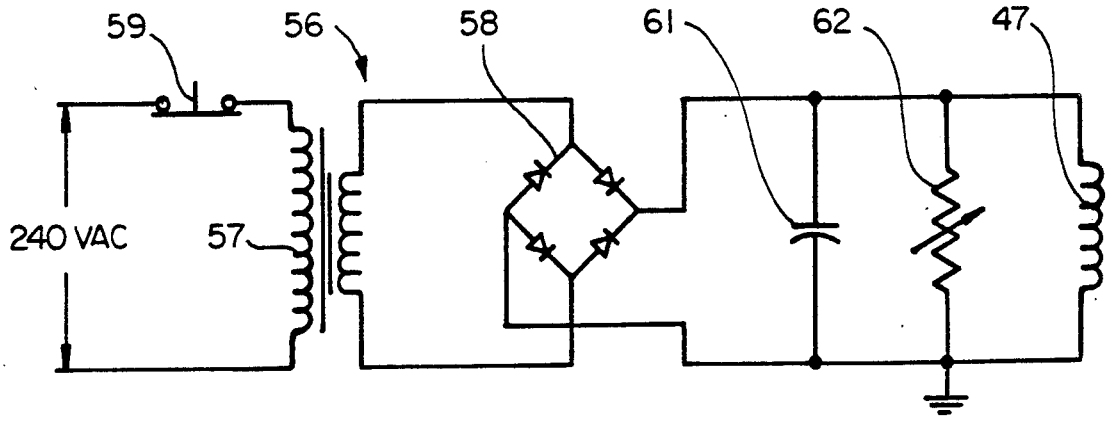
FIG. 3 is a circuit diagram of the release mechanism in the embodiment of FIG. 1.
Figure 4:
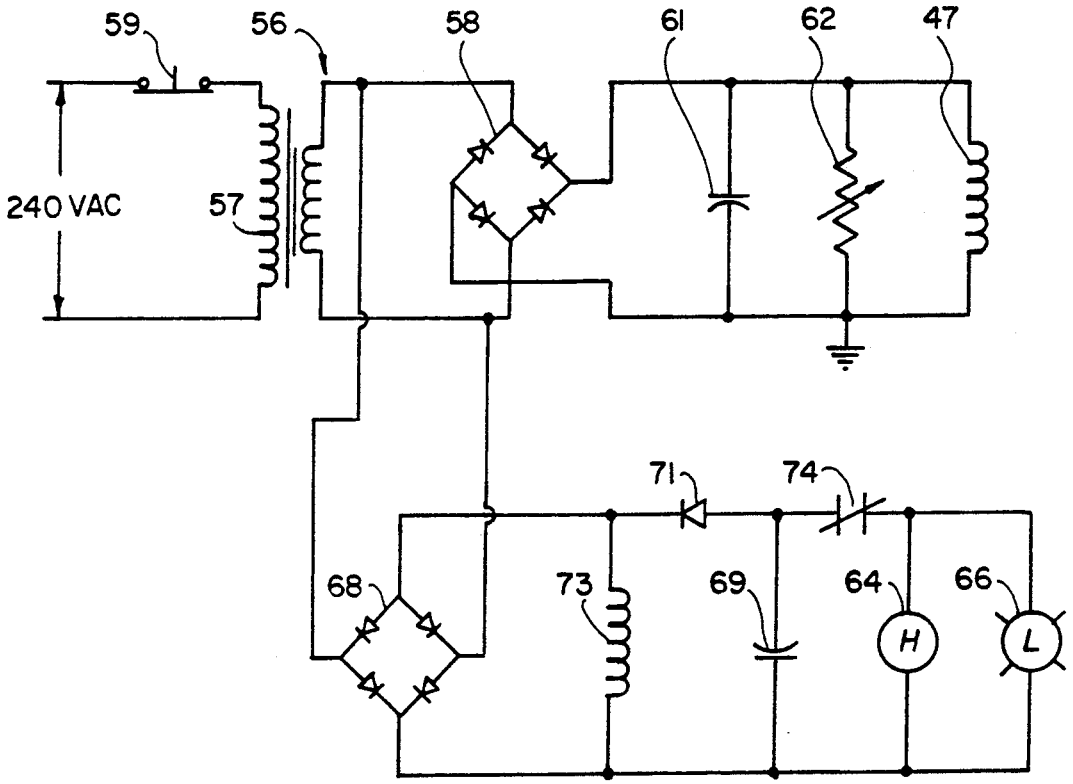
FIG. 4 is a circuit diagram of an embodiment of a release mechanism having an alarm circuit in accordance with the invention.

In the embodiment of FIG. 4, an alarm circuit is added to the circuit of FIG. 3, and like reference numerals designate corresponding elements in the two embodiments. The alarm circuit comprises a horn 64 and a light 66 which provide audible and visual indications of an alarm condition when actuated. Operating power for the alarm circuit is obtained from the secondary winding of transformer 57 through a rectifier bridge 68.

Energy for actuating the alarm devices is stored in a capacitor 69 connected to the output of the rectifier bridge by a diode 71. The cathode of the diode is connected to the negative output terminal of the rectifier bridge, the anode of the diode is connected to one side of the capacitor, and the other side of the capacitor is connected to the positive output terminal of the rectifier.

Energization of the alarm devices is controlled by a relay having an operating coil 73 connected across the output terminals of the rectifier bridge and a set of contacts 74 connected between the capacitor and the horn and light. The contacts are normally closed in that they are open when the operating coil is energized and closed to complete a circuit between the capacitor and the alarm devices when the coil is deenergized.

In operation, the circuit of FIG. 4 operates in a manner similar to the circuit of FIG. 3 in controlling the release of the release mechanism and the door controlled thereby, and the alarm circuit provides a warning before the door drops. Prior to the interruption of current, capacitor 69 is charged through diode 71 with energy from the source, and relay coil 73 keeps contacts 74 open so the alarm devices (horn 64 and light 66) are deenergized. When the current to the coil is interrupted, the contacts close, and the alarm devices are energized with the energy stored in capacitor 69. The polarity of diode 71 is such that the relay coil is not energized by current from the capacitor, and consequently the relay contacts remain closed until power from the source is once again restored The warning given by the alarm circuit begins when the power from the source is interrupted and continues until the power is restored or the energy stored in the capacitor is depleted The time required to deplete the energy is dependent upon the size (i.e. capacitance) of the capacitor and the amount of current drawn by the alarm devices, and the capacitor is preferably made large enough that the warning will continue at least until the door has closed.

The invention has a number of important features and advantages. It provides a release mechanism and method in which actuation is delayed to permit testing or restoration of operating power before a door controlled by the mechanism is released. It is reliable in operation and eliminates the need for dashpots or other mechanical devices to actuation of the mechanism. In addition, it provides a warning when power is interrupted and the door is about to close.

It is apparent from the foregoing that a new and improved release mechanism and method have been provided. While only certain presently preferred embodiments have been described in detai' as will be apparent to those familiar with the art, certain changes and modifications can be made without departing from the scope of the invention as defined by the following claims.

I claim:

1. In a release mechanism: a retaining member, electrically operated means for holding the retaining member in a holding position when energized and for releasing the retaining member from the holding position when deenergized, an alarm device, a source for supplying an energizing current to the electrically operated means, and means connected to the source and to the electrically operated means and to the alarm device for storing a limited amount of energy from the source and delivering an energizing current to the electrically operated means and to the alarm device for a limited period of time after interruption of the current from the source.

2. The mechanism of claim 1 wherein the means for storing energy and delivering current comprises a capacitor.

3. The mechanism of claim 1 wherein the means for storing energy and delivering current comprises a first capacitor connected to the electrically operated means and a second capacitor connected to the alarm device.

4. In a release mechanism: a retaining member, an electrically energized coil for magnetically holding the retaining member in a holding position when energized and for releasing the retaining member from the holding position when deenergized, a source for supplying an energizing current to the coil, a first capacitor connected to the source and to the coil for storing energy from the source and delivering an energizing current to the coil for a limited period of time after interruption of the current from the source, an alarm device, a second capacitor for storing energy from the source, and means for delivering an energizing current from the second capacitor to the alarm device in response to an interruption of current from the source.

5. In combination: a door movable between open and closed positions, means urging the door toward its closed position, a retaining member connected to the door for holding the door in its open position, electrically operated means for holding the retaining member in a holding position when energized and for releasing the retaining member from the holding position when deenergized, an alarm device, a source for supplying an energizing current to the electrically operated means, and means connected to the source and to the electrically operated means and to the alarm device for storing a limited amount of energy from the source and delivering an energizing current to the electrically operated means and to the alarm device for a limited period of time after interruption of the current from the source.

6. The combination of claim 5 wherein the means for storing energy and delivering current comprises a capacitor.

7. The combination of claim 5 wherein the means for storing energy and delivering current comprises a first capacitor connected to the electrically operated means and a second capacitor connected to the alarm device.

8. In method of operating a release mechanism having a retaining member, an electrically operated actuator for holding the retaining member in a holding position when energized and for releasing the retaining member from the holding position when deenergized, and an electrically actuated alarm device, the steps of: supplying an energizing current to the actuator from a source to energize the actuator, storing a limited amount of energy from the source, interrupting the delivery of current from the source to the actuator, energizing the actuator with a portion of the stored energy to prevent release of the retaining member for a limited period of time after the current is interrupted, and actuating the alarm device with a portion of the stored energy when the current is interrupted.

9. The method of claim 8 wherein the energy is stored in a capacitor.

10. The method of claim 8 wherein the portion of the energy with which the actuator is energized is stored in a first capacitor, and the portion of the energy with which the alarm device is actuated is stored in a second capacitor.

11. In a release mechanism: a retaining member, electrically controlled means for holding the retaining member in a holding position, an alarm device, a source of electrical energy, storage means for storing energy from the source, means responsive to an interruption of current from the source for supplying energy from the storage means to the electrically controlled means to cause the retaining member to be released from the holding position a predetermined time after the interruption, and means responsive to the interruption for supplying an operating current from the storage means to the alarm device to actuate the alarm device before the retaining member is released from the holding position.

12. The release mechanism of claim 11 wherein the storage means comprises a first capacitor for supplying energy to the electrically controlled means and a second capacitor for supplying the operating current to the alarm device.

13. The release mechanism of claim 11 wherein the means for supplying the operating current from the storage means to the alarm device comprises a relay having a set of normally closed contacts connected between the storage means and the alarm device, and an operating coil energized by current from the source for holding the contacts in an open position until the current from the source is interrupted.

14. In combination: a door movable between open and closed positions, means urging the door toward its closed position, a retaining member connected to the door and having a holding position for holding the door in its open position, electrically controlled means for holding the retaining member in its holding position, an alarm device, a source of electrical energy, storage means for storing energy from the source, means responsive to an interruption of current from the source for supplying energy from the storage means to the electrically controlled means to cause the retaining member to be released from its holding position a predetermined time after the interruption, and means responsive to the interruption for supplying an operating current from the storage means to the alarm device to actuate the alarm device before the retaining member is released from its holding position.

15. The combination of claim 14 wherein the storage means comprises a first capacitor for supplying energy to the electrically controlled means and a second capacitor for supplying the operating current to the alarm device.

16. The combination of claim 14 wherein the means for supplying the operating current from the storage means to the alarm device comprises a relay having a set of normally closed contacts connected between the storage means and the alarm device, and an operating coil energized by current from the source for holding the contacts in an open position until the current from the source is interrupted.

17. In method of operating a release mechanism having a retaining member, an electrically operated actuator for moving the retaining member between holding and releasing positions, and an electrically actuated alarm device, the steps of: storing energy from a power source, detecting an interruption of current from the source, energizing the actuator with a portion of the stored energy so that the retaining member moves to the releasing position a predetermined time after the current is interrupted, and actuating the alarm device with a portion of the stored energy when the current is interrupted.

18. The method of claim 17 wherein the energy is stored in a capacitor.

19. The method of claim 17 wherein the portion of the energy with which the actuator is energized is stored in a first capacitor, and the portion of the energy with which the alarm device is actuated is stored in a second capacitor.

* * * * *